US006540220B2

(12) United States Patent
Kuo et al.

(10) Patent No.: US 6,540,220 B2
(45) Date of Patent: Apr. 1, 2003

(54) PAPER FEEDING SYSTEM WITH BOTH PAPER ENGAGING AND PAPER SEPARATING MECHANISMS

(75) Inventors: Ying-Hsien Kuo, Taipei (TW); Tsung-Te Lin, San-Chung (TW)

(73) Assignee: Beng Corporation, Taoyuan (TW)

( * ) Notice: Subject to any disclaimer, the term of this patent is extended or adjusted under 35 U.S.C. 154(b) by 167 days.

(21) Appl. No.: 09/740,895

(22) Filed: Dec. 21, 2000

(65) Prior Publication Data

US 2001/0015519 A1 Aug. 23, 2001

(30) Foreign Application Priority Data

Feb. 18, 2000 (TW) ..... 89102744 A

(51) Int. Cl.[7] ..... B65H 3/06; B65H 3/52
(52) U.S. Cl. ..... 271/118; 271/110; 271/124
(58) Field of Search ..... 271/10.02, 10.03, 271/10.11, 118, 121, 124, 110

(56) References Cited

U.S. PATENT DOCUMENTS 4,235,432 A * 11/1980 Marschke ..... 271/124
4,635,922 A * 1/1987 Roetter et al. ..... 271/121
4,925,062 A * 5/1990 Tsukamoto et al. ..... 271/118
4,934,686 A * 6/1990 Ono et al. ..... 271/118
5,004,217 A * 4/1991 Kano et al. ..... 271/10.11
5,386,983 A * 2/1995 Ando ..... 271/118
5,823,524 A * 10/1998 Kawada ..... 271/121
5,984,298 A * 11/1999 Wada et al. ..... 271/121
6,349,931 B1 * 2/2002 Kuo et al. ..... 271/121

* cited by examiner

*Primary Examiner*—Michael R. Mansen
(74) *Attorney, Agent, or Firm*—Winston Hsu

(57) ABSTRACT

A paper feeding system has a housing, a paper tray, a paper path positioned before a front end of the paper tray, a paper engaging mechanism installed above the paper tray, a paper separating mechanism, and a driving device. The paper engaging mechanism comprises an engaging arm and an engaging roller. The engaging arm comprises a first fixing shaft rotatably installed on the housing, and a second end installed with the engaging roller. When the engaging arm swings down to the paper tray, the engaging roller pushes at least a sheet of paper from the paper tray to the paper path. The paper separating mechanism comprises a separating roller and a friction pad installed respectively above and below the paper path. When two sheets of paper pass between a gap between the friction pad and the separating roller, the separating roller will move only the top sheet forward. The driving device is used to drive the engaging arm, the engaging roller, and the separating roller. When the driving device begins to run, the engaging arm will rotate down to the paper tray, and the engaging roller will rotate and move the sheet of paper from the paper tray into the paper path. Then the separating roller of the paper separating mechanism will successively move individual sheets along the paper path.

20 Claims, 5 Drawing Sheets

PAPER FEEDING SYSTEM WITH BOTH PAPER ENGAGING AND PAPER SEPARATING MECHANISMS

BACKGROUND OF THE INVENTION

1. Field of the Invention

The present invention relates to a paper feeding system, and more particularly, to a paper feeding system with both paper engaging and paper separating mechanisms.

2. Description of the Prior Art

Paper feeding systems are widely used in copiers, printers, and fax machines. The primary function of a paper feeding system is to pick a single sheet of paper from a stack of paper and convey it to another device for subsequent processing.

Please refer to FIG. 1. FIG. 1 is a schematic diagram of a prior art paper feeding system 10. The paper feeding system 10 comprises a paper tray 12, a supporting plate 14, a lifting lever 16, and an engaging roller 18. When the lifting lever 16 rotates counterclockwise and lifts the supporting plate 14, a sheet 11 of paper will come into contact with the engaging roller 18. The rotation of the engaging roller 18 moves the sheet 11 from the paper tray 12 to achieve a feeding function. However, because the paper feeding system 10 uses only the engaging roller 18 for paper feeding, double feeding may occur due to friction between the sheets, and the sheets of paper may jam as a result.

SUMMARY OF THE INVENTION

It is therefore a primary objective of the present invention to provide a paper feeding system with both paper engaging and paper separating mechanisms to solve the above-mentioned problem.

In a preferred embodiment, the present invention provides a paper feeding system that has a housing, a paper tray installed in the housing, a paper path set just in front of the paper tray, a paper engaging mechanism installed above the paper tray, and a paper separating mechanism that is installed both above and below the paper path. The paper tray holds stacked sheets of paper. The paper engaging mechanism has an engaging arm with an engaging roller. The engaging arm can swing down to bring the engaging roller into contact with the top sheet of paper in the paper tray. The paper separating mechanism comprises a separating roller installed above the paper path, and a friction pad installed below the paper path. A driving mechanism causes the engaging arm to swing down to the paper tray. The engaging roller moves paper from the paper tray into the paper path. The separating roller will move the top sheet forward. The friction pad will prevent a bottom sheet from going forward. Hence, only single sheet of paper moves forward along the paper path.

It is an advantage of the present invention that the paper feeding system has both paper engaging and paper separating mechanisms. Thus, there will be a lower probability of double feeding or paper jam.

This and other objectives of the present invention will no doubt become obvious to those of ordinary skill in the art after having read the following detailed description of the preferred embodiment, which is illustrated in the various figures and drawings.

DETAILED DESCRIPTION OF THE PREFERRED EMBODIMENT

Figure 1:
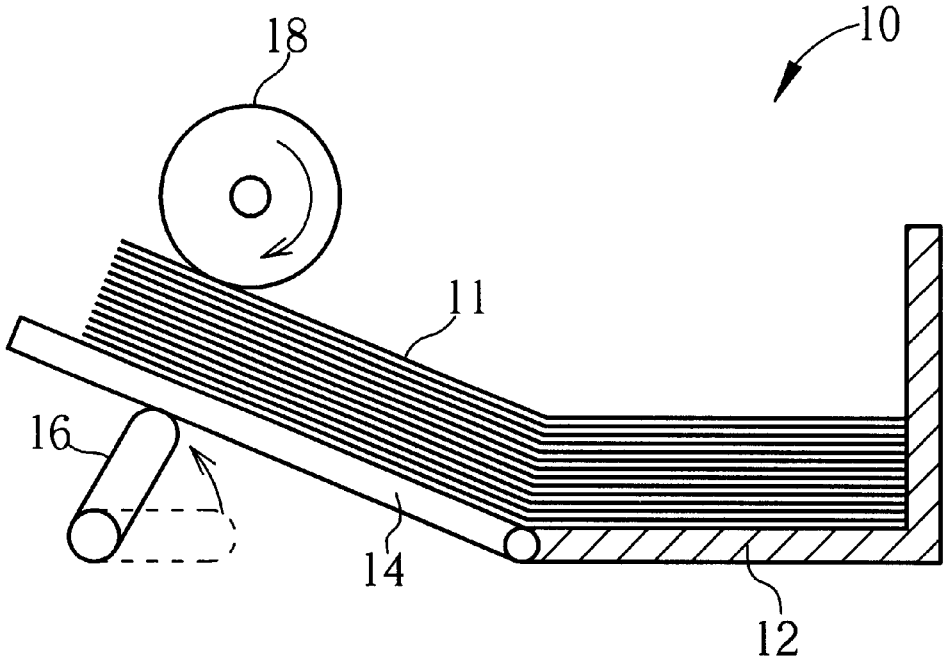
Fig. 1 Prior art
FIG. 1 is a side view of a prior art paper feeding system.
Figure 2:
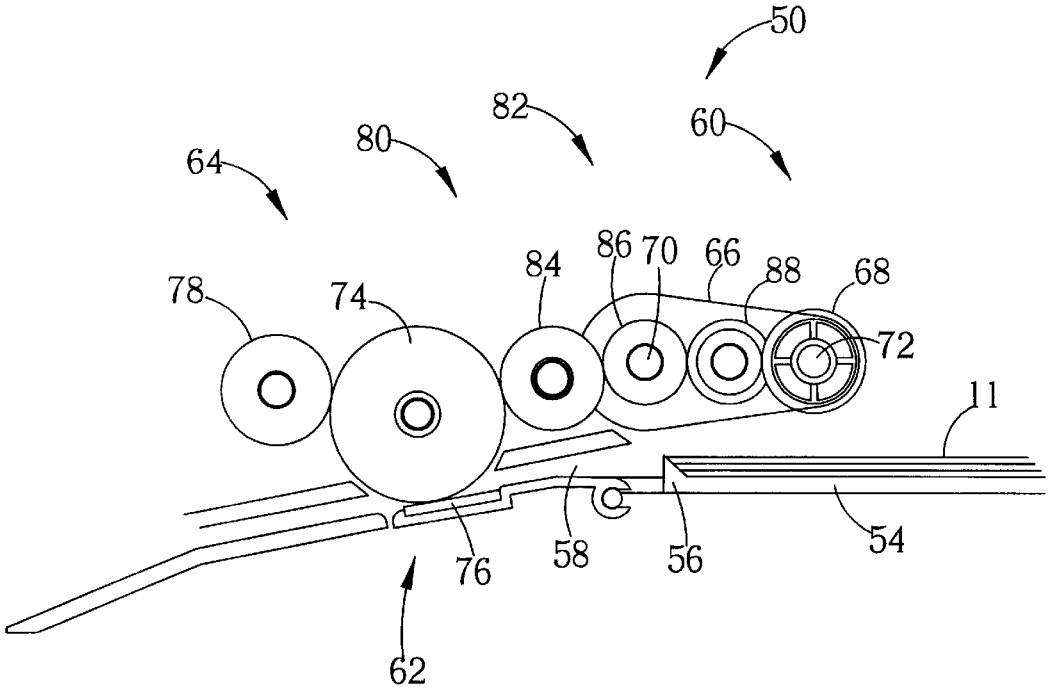
FIG. 2 is a side view of a paper feeding system according to the present invention.
Figure 3:
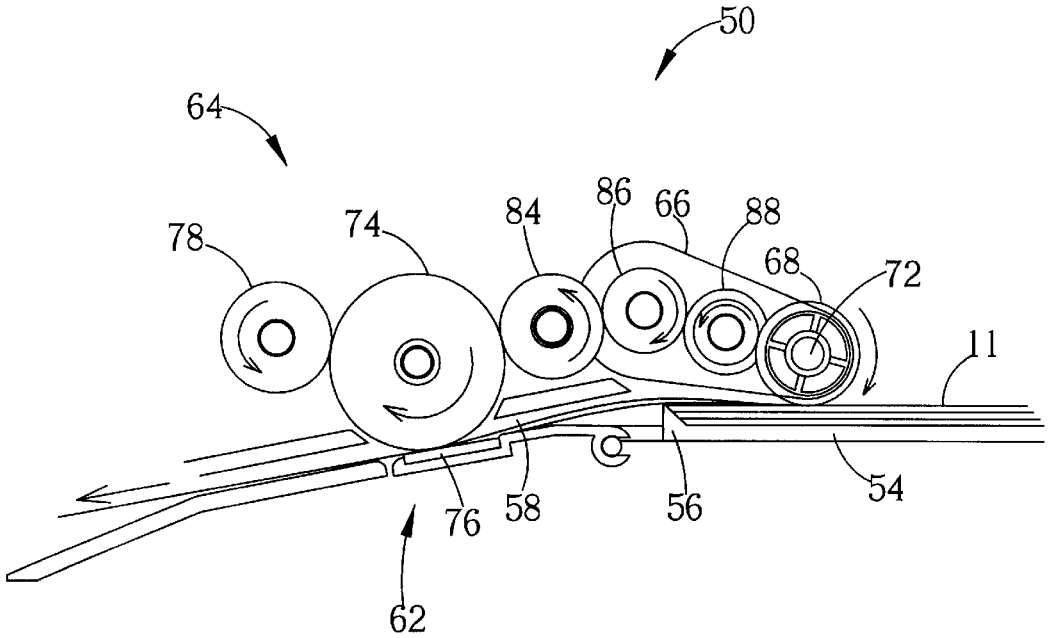
FIG. 3 is a side view of the paper feeding system shown in FIG. 2 during a feeding action.

Please refer to FIG. 2 and FIG. 3. FIG. 2 is a side view of a paper feeding system 50 according to the present invention. FIG. 3 is a side view of the paper feeding system 50 shown in FIG. 2 during a feeding action. The paper feeding system 50 according to the present invention comprises a housing (not shown), a paper tray 54 installed in the housing for holding sheets 11 of paper, a paper path 58, a paper engaging mechanism 60 installed above the paper tray 54, a paper separating mechanism 62, and a driving device 64. The paper tray 54 comprises a front end 56, and the paper path 58 is positioned just before the front end 56 of the paper tray 54. The paper engaging mechanism 60 comprises an engaging arm 66 and an engaging roller 68. The engaging arm 66 comprises a first fixing shaft 70 at one end and a second end 72 at the other end of the engaging arm 66. The first fixing shaft 70 is rotatably installed on the housing, and the engaging arm 66 can rotate around the first fixing shaft 70. Therefore, the second end 72 of the engaging arm 66 can reach down to, or up from, the paper tray 54. The engaging roller 68 is rotatably installed on the second end 72. When the engaging arm 66 swings down to the paper tray 54, the engaging roller 68 contacts a sheet 11 of paper and pushes the sheet 11 of paper from the paper tray 54 to the paper path 58 through the front end 56 of the paper tray 54.

The paper separating mechanism 62 comprises a separating roller 74 and a friction pad 76. The separating roller 74 is installed above the paper path 58, and the friction pad 76 is installed below the paper path 58. When two sheets 11 of paper pass between a gap between the friction pad 76 and the separating roller 74, the separating roller 74 will move the top sheet 11 forward, and the friction pad 76 will stop the lower sheet 11 until the top sheet 11 has passed through.

The driving device 64 is used to drive the engaging arm 66, the engaging roller 68, and the separating roller 74. The driving device 64 comprises a motor 78 to provide torque, and a transmission device 80 to deliver the torque. The transmission device 80 is positioned between the engaging arm 66, the engaging roller 68, and the separating roller 74. The transmission device 80 comprises a gear set 82 to deliver the torque to the engaging arm 66, the engaging roller 68, and the separating roller 74. The gear set 82 comprises 3 transmission gears 84, 86, and 88. When the motor 78 rotates in a predetermined direction, the transmission device 80 will rotatably drive the engaging arm 66, the engaging roller 68, and the separating roller 74 concurrently. As shown in FIG. 3, when the motor 78 rotate counterclockwise, the separating roller 74 will rotates clockwise, it drives the transmission gear 84 to rotate counterclockwise. The transmission gear 84 will drive the transmission gear 86 and the engaging arm 66 to rotate clockwise. The transmission gear 86 will drive the transmission gear 88 to rotate counterclockwise, and the engaging roller 68 will be driven by the transmission gears 88 to rotate clockwise.

As shown in FIG. 3, when the driving device 64 begins to run, i.e. the motor 78 rotates counterclockwise, the engaging arm 66 will rotate and the second end 72 of the engaging arm 66 will move down to the paper tray 54. The engaging roller 68 will come into contact with the sheet 11 of paper. The engaging roller 68 will rotate and move at least one sheet 11 of paper from the paper tray 54 into the paper path 58, and the separating roller 74 of the paper separating mechanism 62 will then successively move individual sheets 11 along the paper path 58.

Figure 4:
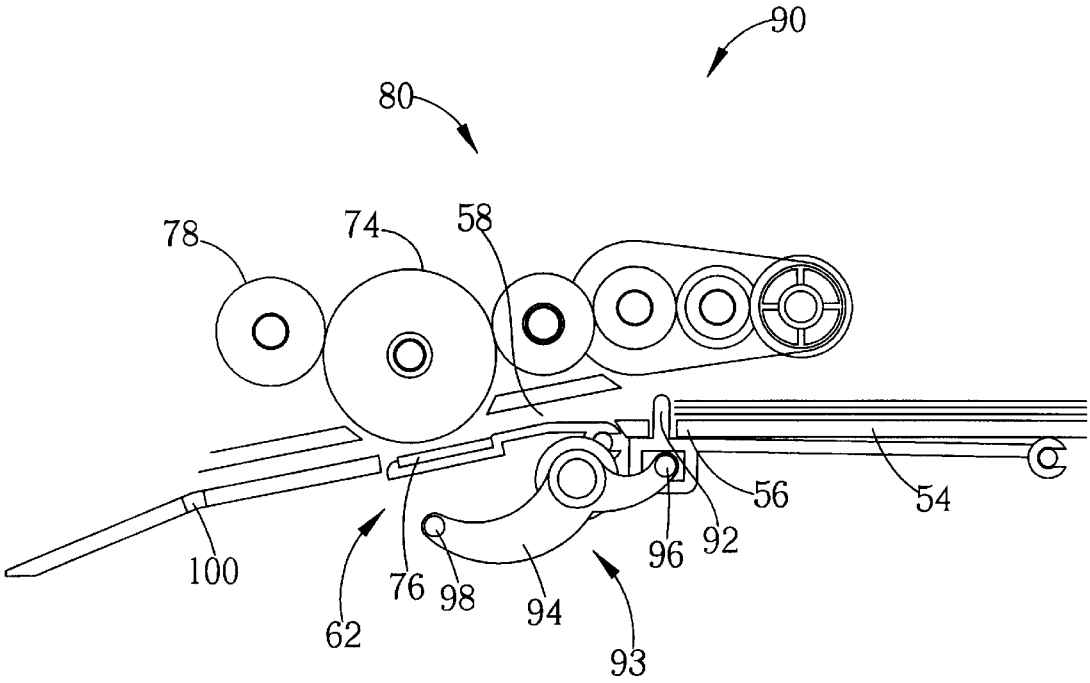
FIG. 4 is a side view of another embodiment of a paper feeding system according to the present invention.
Figure 5:
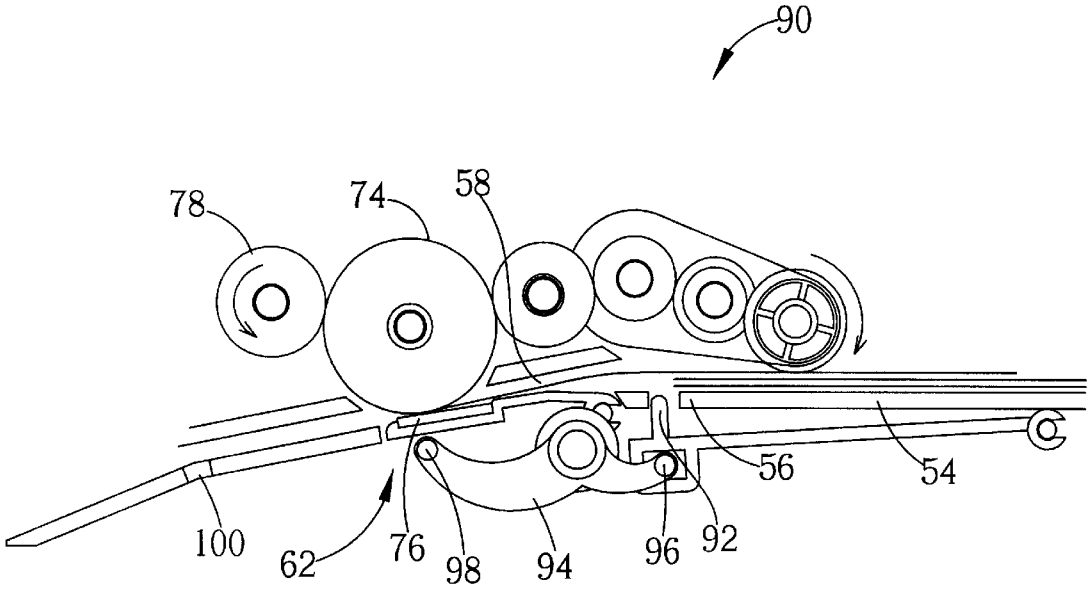
FIG. 5 is a side view of the paper feeding system shown in FIG. 4 during a feeding action.

Please refer to FIG. 4 and FIG. 5. FIG. 4 is a side view of another embodiment paper feeding system 90 according to the present invention. FIG. 5 is a side view of the paper feeding system 90 shown in FIG. 4 during a feeding action. Differing from the paper feeding system 50, the paper feeding system 90 further comprises a paper restrainer 92 that is removably installed at the front end 56 of the paper tray 54, and a driven device 93 installed in the housing and driven by the transmission device 80. The paper restrainer 92 is used to prevent the paper in the paper tray 54 from moving into the paper path 58. The driven device 93 is a driven lever 94. A first driven end 96 is connected to one end of the driven lever 94, and a second driven end 98 is connected to another end of the driven lever 94. The first and second driven ends 96, 98 of the driven lever 94 are positioned under the paper restrainer 92 and the friction pad 76, respectively. The first and second driven ends 96, 98 of the driven lever 94 are used to drive the paper restrainer 92 and the friction pad 76 respectively. Besides rotatably driving the engaging arm 66, the engaging roller 68, and the separating roller 74, the transmission device 80 will also concurrently drive the driven lever 94. The transmission device 80 further comprises another gear set (not shown) to drive the driven lever 94.

As shown in FIG. 5, when the motor 78 rotates counterclockwise, the first driven end 96 of the driven lever 94 will be driven downwards to remove the paper restrainer 92 from the front end 56 of the paper tray 54 to allow sheets of paper to be carried into the paper path 58 and, concurrently, the second driven end 98 will be driven upwards to push the friction pad 76 against the separating roller 74, so that the separating roller 74 of the paper separating mechanism 62 will convey a sheet to move along the paper path 58.

When the motor 78 rotates clockwise, the first driven end 96 will be driven upwards to move the paper restrainer 92 to the front end 56 of the paper tray 54 and, concurrently, the second driven end 98 will be driven downwards to separate the friction pad 76 from the separating roller 74. After this, the separating roller 74 of the paper separating mechanism 62 cannot convey paper further along the paper path 58, and cannot convey the sheet back towards the paper tray 54. The state of the paper feeding system 90 returns to the state shown in FIG. 4.

The paper feeding system 90 further comprises a sensing device 100 installed along the paper path 58 and at the rear of the paper separating mechanism 62. The sensing device 100 senses the sheets of paper as they pass the sensing device 100. The paper feeding system 90 also comprises a control circuit (not shown) for controlling the rotational direction of the motor 78 according to an output generated by the sensing device 100. Before a front edge of a sheet passes through the paper separating mechanism 62, the control circuit will control the motor 78 to rotate counterclockwise to feed paper. When the front edge of the sheet passes through the paper separating mechanism 62 and is sensed by the sensing device 100, the control circuit will control the motor to rotate clockwise to stop feeding paper, and another process like skew alignment, copying, or scanning for example, is performed.

Figure 6:
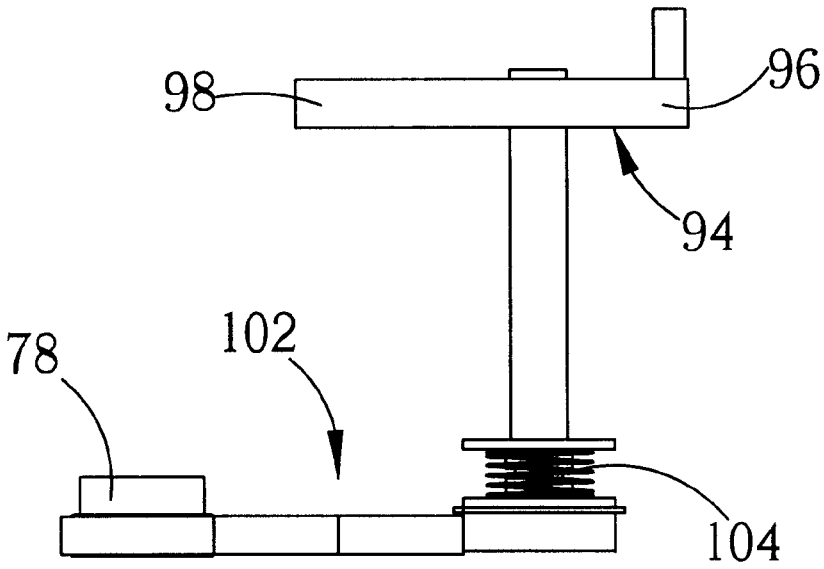
FIG. 6 is a side view showing a transmission device of the paper feeding system shown in FIG. 4.

Please refer to FIG. 6. FIG. 6 is a side view of the transmission device 80 of the paper feeding system 90 shown in FIG. 4 that drives the driven lever 94. The transmission device 80 of the paper feeding system 90 further comprises a gear set 102 and a torque limiter 104 for limiting the torque transmitted to the driven lever 94. The torque limiter 94 is used to ensure that after the second driven end 98 pushes the friction pad 76 against the separating roller 74 or the first driven end 96 moves the paper restrainer 92 to the front end 56 of the paper tray 54, the motor 78 can still drive the engaging arm 66, the engaging roller 68, and the separating roller 74.

Figure 7:
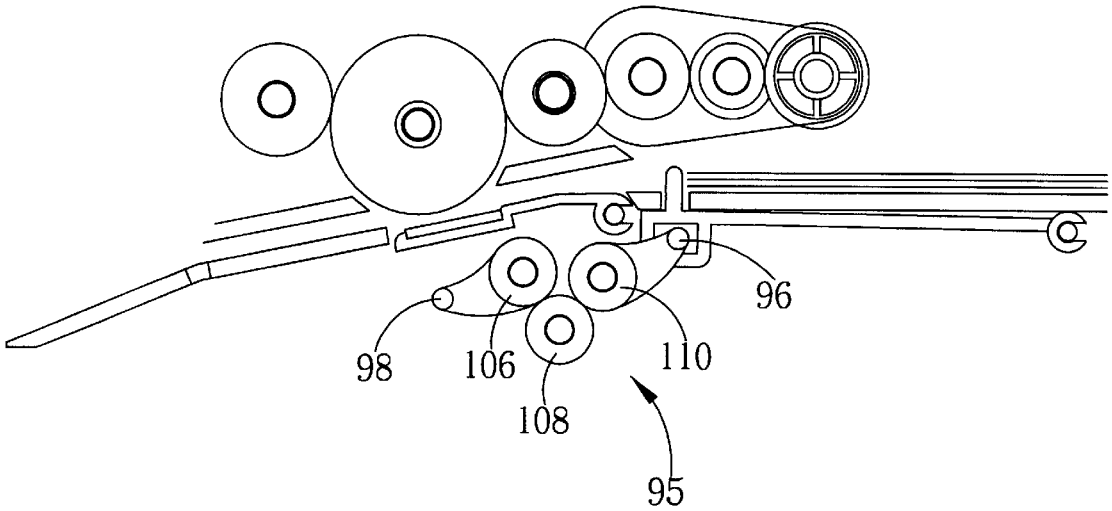
FIG. 7 is a side view of another driven device of the paper feeding system shown in FIG. 4.

Please refer to FIG. 7. FIG. 7 is a schematic diagram of another driven device 95 of the paper feeding system 90 shown in FIG. 4. The main difference between the driven device 95 shown in FIG. 7 and the driven device 93 shown in FIG. 4 is that the driven device 95 comprises 3 gears 106, 108, and 110. The first driven end 96 of the driven device 95 is connected to the gear 110, and the second driven end 98 of the driven device 95 is connected to the gear 106. In this manner, as long as any of the three gears 106, 108, or 110 is driven, the first driven end 96 and the second driven end 98 of the driven device 95 can still be driven upwards or downwards to achieve the functionality described above.

Compared with the prior art paper feeding system 10, the paper feeding system 50, 90 according to the present invention comprises both paper engaging and paper separating mechanisms 60, 62, and the probability of double feeding, misfeeding, or paper jamming is thus reduced. Furthermore, the paper engaging and paper separating mechanisms 60, 62 are concurrently driven by the motor 78 of the driving device 64. When the driving device 64 begins to operate, the engaging arm 66 will rotate and the second end 72 will move down to the paper tray 54. The engaging roller 68 will contact a sheet of paper, rotate and move at least one sheet of paper from the paper tray 54 into the paper path 58. The separating roller 74 of the paper separating mechanism 62 will then successively move individual sheets along the paper path 58. The present invention further provides the driven device 93, 95, which not only reduces feeding errors of the paper engaging and paper separating mechanisms 60, 62 when driven concurrently, but also reduces the number of mechanisms needed.

Those skilled in the art will readily observe that numerous modifications and alternations of the device may be made while retaining the teachings of the invention. Accordingly, the above disclosure should by construed as limited only by the metes and bounds of the appended claims.

What is claimed is:

1. A paper feeding system comprising:

a housing;

a paper tray installed in the housing for holding sheets of paper, the paper tray comprising a front end;

a paper path positioned before the front end of the paper tray;

a paper engaging mechanism installed above the paper tray, the paper engaging mechanism comprising:

an engaging arm comprising a first fixing shaft at one end and a second end at the other end of the engaging arm, the first fixing shaft rotatably installed on the housing and the engaging arm capable of rotating around the first fixing shaft, the second end of the engaging arm therefore capable of reaching down to or up from the paper tray; and an engaging roller installed on the second end, the engaging roller capable of conveying at least a sheet of paper from the paper tray to the paper path through the front end of the paper tray when the engaging arm swings down to the paper tray;

a paper separating mechanism comprising a separating roller and a friction pad, the separating roller installed above the paper path, the friction pad installed below the paper path, wherein when two sheets of paper pass between the friction pad and the separating roller, the separating roller will move the top sheet forward and the friction pad will stop the lower sheet;

a paper restrainer removably installed at the front end of the paper tray, the paper restrainer capable of preventing the paper in the paper tray from moving into the paper path;

a driven device installed in the housing, the driven device comprising a first driven end for driving the paper restrainer, and a second driven end for driving the friction pad; and a driving device comprising a motor to provide torque and a transmission device for providing the torque to the engaging arm, the engaging roller, the driven device, and the separating roller, wherein when the motor rotates in a predetermined direction, the transmission device rotatably drives the engaging arm, the engaging roller, the separating roller and the driven device concurrently, the engaging arm will rotate down to the paper tray, the engaging roller will rotate and move at least a sheet of paper from the paper tray into the paper path, the first driven end will remove the paper restrainer from the front end of the paper tray to allow sheets of paper to be carried into the paper path, and the second driven end will push the friction pad against the separating roller so that the separating roller will successively convey individual sheets along the paper path.

2. The paper feeding system of claim 1, wherein the transmission device comprises a gear set to deliver the torque to the engaging arm, the engaging roller, and the separating roller.

3. The paper feeding system of claim 1, wherein the driven device is a driven lever, the first driven end is connected to one end of the driven lever, and the second driven end is connected to another end of the driven lever.

4. The paper feeding system of claim 1, wherein the driven device comprises a plurality of gears, the first driven end is connected to one of the gears, and the second driven end is connected to another of the gears.

5. The paper feeding system of claim 1, wherein the first driven end and the second driven end of the driven device are positioned under the paper restrainer and friction pad, respectively, wherein when the motor rotates in the predetermined direction, the transmission device will drive the first driven end downwards to remove the paper restrainer from the front end of the paper tray, and drive the second driven end upwards to push the friction pad against the separating roller.

6. The paper feeding system of claim 5, wherein when the motor rotates in a direction counter to the predetermined direction, the first driven end will be driven upwards to move the paper restrainer to the front end of the paper tray, and the second driven end will be driven downwards to separate the friction pad from the separating roller.

7. The paper feeding system of claim 6 further comprising a sensing device installed beside the paper path and at the rear of the paper separating mechanism for sensing the sheets of paper, and a control circuit for controlling the rotational direction of the motor according to an output from the sensing device, wherein before a front edge of a sheet passes through the paper separating mechanism, the control circuit will control the motor to rotate in the predetermined direction, and when the front edge of the sheet passes through the paper separating mechanism and is sensed by the sensing device, the control circuit will control the motor to rotate in a direction counter to the predetermined direction.

8. The paper feeding system of claim 6, wherein the transmission device further comprises a torque limiter for limiting the torque transmitted to the driven device, the torque limiter ensuring that after the second driven end pushes the friction pad against the separating roller or the first driven end moves the paper restrainer to the front end of the paper tray, the motor can still drive the engaging arm, the engaging roller, and the separating roller.

9. A paper feeding system comprising:

a paper tray for holding sheets of paper;

a paper path arranged in front of the paper tray;

a paper engaging mechanism installed above the paper tray, comprising:

an engaging arm comprising a fixed end and a rotatory end, the rotatory end capable of rotating around the fixed end, the rotatory end are therefore capable of reaching down to or up from the paper tray; and an engaging roller installed on the rotatory end, the engaging roller capable of conveying at least a sheet of paper from the paper tray to the paper path when the engaging arm swings down to the paper tray;

a paper separating mechanism comprising a first separating device and a second separating device, the first separating device installed above the paper path, the second separating device installed below the paper path, wherein when two sheets of paper pass between the first separating device and the second separating device, the first separating device will move the top sheet forward and the second separating device will stop the lower sheet;

a paper restrainer removably installed at a front end of the paper tray, the paper restrainer capable of preventing the paper in the paper tray from moving into the paper path; and a driven device comprising a first driven end for driving the paper restrainer, and a second driven end for driving the second separating device, wherein when the rotatory end reaches down to the paper tray, the first driven and will remove the paper restrainer from the front end of the paper tray to allow sheets of paper to be carried into the paper path, and the second driven end will push the second separating device against the first separating device so that the first separating device is capable of conveying a sheet along the paper path.

10. The paper feeding system of claim 9, wherein the first separating device is a separating roller.

11. The paper feeding system of claim 9, wherein the second separating device is a friction pad.

12. The paper feeding system of claim 9, wherein the driven device is a driven lever, the first driven end is connected to one end of the driven lever, and the second driven end is connected to another end of the driven lever.

13. The paper feeding system of claim 9, wherein the first driven end is located under the paper restrainer and the second driven end is located under the second separating device, wherein when the rotatory end reaches down to the paper tray, the first driven end moves downwards to remove the paper restrainer from the front end of the paper tray, and the second driven end moves upwards to push the second separating device against the first separating device.

14. The paper feeding system of claim 9, wherein the driven device comprises a plurality of gears, the first driven end is connected to one of the gears, and the second driven end is connected to another of the gears.

15. The paper feeding system of claim 9, wherein the first separating device is a separating roller.

16. The paper feeding system of claim 9, wherein the second separating device is a friction pad.

17. A paper feeding system comprising:

a paper tray for holding sheets of paper;

a paper path disposed in front of the paper tray;

a paper engaging mechanism disposed above the paper tray for conveying at least a sheet of paper from the paper tray to the paper path;

a paper separating mechanism comprising a first separating device and a second separating device, the first separating device disposed above the paper path, the second separating device disposed below the paper path, wherein when two sheets of paper pass through the first separating device and the second separating device, the first separating device will move the top sheet forward and the second separating device will stop the lower sheet;

a paper restrainer removably installed between the paper tray and the paper path, the paper restrainer capable of preventing the paper in the paper tray from moving into the paper path; and a driven device comprising a first driven end and a second driven end, the first driven end coupled to the paper restrainer and the second driven end coupled to the second separating device, wherein when the paper engaging mechanism is conveying the sheet of paper out of the paper tray, the first driven end is driven to remove the paper restrainer away from the paper tray, and the second driven end is driven to push the second separating device against the first separating device.

18. The paper feeding system of claim 17, wherein the paper engaging mechanism comprises:

an engaging arm comprising a fixed end and a rotatory end, the rotatory end capable of rotating around the fixed end, the rotatory end are therefore capable of reaching down to or up from the paper tray; and an engaging roller installed on the rotatory end, the engaging roller capable of conveying at least a sheet of paper from the paper tray to the paper path when the engaging arm swings down to the paper tray.

19. The paper feeding system of claim 18, wherein the first driven end is located under the paper restrainer and the second driven end is located under the second separating device, wherein when the rotatory end reaches down to the paper tray, the first driven end moves downwards to remove the paper restrainer from the paper tray, and the second driven end moves upwards to push the second separating device against the first separating device.

20. The paper feeding system of claim 17, wherein the first separating device is a separating roller and the second separating device is a friction pad.

* * * * *

UNITED STATES PATENT AND TRADEMARK OFFICE

CERTIFICATE OF CORRECTION

PATENT NO. : 6,540,220 B2
DATED : April 1, 2003
INVENTOR(S) : Ying-Hsein Kuo et al.

It is certified that error appears in the above-identified patent and that said Letters Patent is hereby corrected as shown below:

Column 6,
Line 55, change “first driven and” to -- first driven end --

Signed and Sealed this

Thirteenth Day of July, 2004

JON W. DUDAS
*Acting Director of the United States Patent and Trademark Office*